US007554023B2

(12) United States Patent
Tyler

(10) Patent No.: US 7,554,023 B2
(45) Date of Patent: Jun. 30, 2009

(54) STRING MOUNTING SYSTEM

(75) Inventor: Mark Tyler, Chepstow (GB)

(73) Assignee: Merak Limited (GB)

( * ) Notice: Subject to any disclaimer, the term of this patent is extended or adjusted under 35 U.S.C. 154(b) by 0 days.

(21) Appl. No.: 11/631,715

(22) PCT Filed: Jul. 7, 2005

(86) PCT No.: PCT/GB2005/002689

§ 371 (c)(1),
(2), (4) Date: Apr. 10, 2007

(87) PCT Pub. No.: WO2006/003465

PCT Pub. Date: Jan. 12, 2006

(65) Prior Publication Data

US 2007/0289429 A1 Dec. 20, 2007

(30) Foreign Application Priority Data

Jul. 7, 2004 (GB) ..... 0415216.1

(51) Int. Cl.
*G10D 3/00* (2006.01)
*G10D 3/12* (2006.01)

(52) U.S. Cl. ..... 84/313; 84/173; 84/267; 84/298; 84/299; 84/297 R

(58) Field of Classification Search ..... 84/173, 84/267, 269, 290, 297 R, 298–301, 450, 312 R, 84/313, 453–455; D17/14, 20, 21, 99
See application file for complete search history.

(56) References Cited

U.S. PATENT DOCUMENTS

| | | | | | |
|---|---|---|---|---|---|
| 2,070,916 | A * | 2/1937 | Peate | ..... | 84/297 R |
| 2,130,248 | A * | 9/1938 | Peate | ..... | 84/297 R |
| 2,514,835 | A * | 7/1950 | Bredice | ..... | 84/297 R |
| 4,608,906 | A * | 9/1986 | Takabayashi | ..... | 84/313 |
| 4,928,564 | A * | 5/1990 | Borisoff et al. | ..... | 84/313 |
| 4,955,275 | A * | 9/1990 | Gunn | ..... | 84/313 |

FOREIGN PATENT DOCUMENTS

| | | |
|---|---|---|
| DE | 930 009 C | 7/1955 |

OTHER PUBLICATIONS

International Search Report; Written Opinion of the ISA; and Notification of Transmittal thereof, for Int'l App. No. PCT/GB2005/002689, dated Dec. 6, 2005.

* cited by examiner

*Primary Examiner*—Jeffrey Donels
*Assistant Examiner*—Christopher Uhlir
(74) *Attorney, Agent, or Firm*—Patula & Associates P.C.

(57) ABSTRACT

A string mounting system for a stringed musical instrument (10), comprising a helical tension spring (22*a-f*) connected in series with each string (14*a-f*), each string (14*a-f*) being collinear with its corresponding helical tension spring (22*a-f*), wherein each string (22*a-f*) is provided with an inertial damper (16) which is received within the body of the respective helical tension spring (22*a-f*).

20 Claims, 6 Drawing Sheets

STRING MOUNTING SYSTEM

The present invention relates to a string mounting system for a stringed musical instrument.

Stringed instruments use uniform stretched strings, vibrating at well defined frequencies, to produce musical notes. The pitch of such a note depends essentially on the tension, vibrating length and bulk density of the string. Tuning a given string usually involves fine adjustment of the tension. Once this has been done most instruments are played by varying the effective length of the string by pressing it against a finger- or fret-board, as with a violin or guitar.

If the string tension changes due to stretching or slippage, the string goes "out of tune" and has to be re-adjusted. This may have to be done in the middle of a performance and can be a very annoying problem. The conventional way to reduce the problem is to make the instrument and its string connections very rigid so that significant slippage does not occur. However, with age rigid structures may become less so and, in any case, strings can stretch due to creep, overloading or temperature changes.

The amount by which a string stretches with tension is called its extensibility. The more extensible a string, the less its pitch will change under changes of extension. The extensibility depends on the original length of the string, its cross sectional area and the intrinsic extensibility of the material from which it is made. Most instruments are designed to use strings of specific lengths, so string manufacturers are limited in designing strings of a desired extensibility to choices of string material and cross sectional area.

The problem of string stretching could be reduced if the strings were "softer" i.e. more extensible such that their pitch did not vary so much with changes of tension. However, there are two main problems with this solution. Firstly, as mentioned above, the only way to do this for a particular material would be to make the string thinner. However, a very thin string would lack the necessary strength. The second reason is that on some instruments musicians can manually alter string pitch by applying varying finger pressure, producing effects such as vibrato, which is frequency modulation caused by rhythmically rocking the finger back and forth in a sideways motion, stretching the string slightly. The ability to do this would be impaired by significantly increasing the extensibility of the strings.

Necessary compromises in string design thus mean that strings of adequate strength have relatively low extensibility, making them relatively difficult to tune accurately and more prone to go out of tune due to slippage or stretching or to flexing of the instrument body or play in its string anchor points.

DE 3607252 discloses a string holder for stringed musical instruments in which the tension of the string is supported by means of a spring attached to a swivelling lever arm.

GB 460701 discloses a tuner for stringed musical instruments wherein spring tensioned rods secured to the instrument and to the strings are provided with adjustable markers adapted to indicate the tension of each string when tuned by reference to a fixed mark on the instrument.

It is the object of the present invention to alleviate some of the problems of the prior art or to at least offer an alternative to what is currently available.

According to the present invention there is provided a string mounting system for a stringed musical instrument, comprising a helical tension spring connected in series with each string, each string being collinear with its corresponding helical tension spring, wherein each string is provided with an inertial damper which is received within the body of the respective helical tension spring. This results in the strings behaving in a "softer" manner than conventionally mounted strings.

It is preferred that the mass of the inertial damper is massive in comparison to its respective string. The term "massive" is a relative one and relates to the fact that the mass of the inertial dampers is much larger than that of their respective strings. The inertial dampers act to prevent the helical tension springs from affecting the normal vibration of the strings. However, at the time scale that slippage or stretching occurs the helical tension springs are able to react to tension changes in the strings, effectively stabilising the pitch of the string over time. The consequent "softer" behaviour of the strings means that they can be more accurately tuned, require retuning less frequently and are less prone to accidental breakage.

It is well known for electric guitars to be provided with one or more springs in series with all of the guitar strings. Such devices are known as "Tremolo" or "Whammy" bars and usually comprise several springs connecting the guitar body to a single movable block, the block being a retainer for the ball ends of the strings. In devices such as these all of the strings are constrained to move in unison and such devices may be used to vary the pitch of all of the strings at once. The present invention differs from these devices in that each string is independently connected to a different extensible component.

Each inertial damper preferably comprises an elongate plug with a central passageway through which the string is fed. The diameter of the central passageway is less than that of the ball end of the strings such that the ball end cannot pass through the passageway. In order to fit the string to the instrument it is fed through the plug and secured to the instrument in the conventional manner, usually at a tuning peg. The length of the plug is preferably sufficient to maintain a distance of at least 15 mm from the ball end to the instrument bridge.

The plug is preferably provided with a recess for receiving the ball end of the string. The recess may conveniently be tapered to prevent any edges from cutting the string.

It is preferred that at least a portion of each helical tension spring is tapered from back to front along the length of the spring, that is in a direction towards the head end of the instrument. The tapering ensures that the inertial damper, which is received within the body of the spring, can be easily fed into the spring from the back but is prevented from passing through the spring. The diameter of the spring coils may suitably be constant along its length with only the last two or three coils being tapered.

Each inertial damper is preferably compressed against an internal surface of its corresponding helical tension spring. The string acts on the inertial damper to compress it against the spring. This arrangement results in a much more compact string mounting system than has previously been available.

Each string may conveniently be connected in series with more than one helical tension spring. The helical tension springs may be connected in series with each other or they may be connected in parallel with each other.

Preferably, each helical tension spring is connected in series with a non-vibrating part of the or each string. Most musical instrument strings vibrate between two points but are anchored to the instrument beyond those points, where the string does not vibrate significantly. As used herein the term "non-vibrating part" refers to that part of the string beyond the normal vibrating part. By having the helical tension spring located in series with the non-vibrating part of the string this further prevents the spring from affecting the normal vibration of the string.

It is preferred that one end of the helical tension spring is connected to the stringed musical instrument. This provides a fixed anchor point for the string mounting system. The helical tension springs may conveniently comprise a hooked portion which engages with a bar provided on the body of the instrument. Alternatively, the body of the instrument may be provided with a fixing plate having a flange extending perpendicularly to the body of the instrument. The helical tension springs may then be secured to the instrument by screw threading them into suitably sized apertures on the flange. The apertures on the flange are preferably threaded to receive the springs. This allows the springs to be provided without hooks, which offers the advantage of allowing unrestricted access to the interior space of the spring, thus facilitating easy replacement of the strings when necessary.

When the string mounting system comprises a fixing plate with a flange into which the helical tension springs are threaded it is preferred that a cover is provided for the rear side of the flange to prevent the inertial dampers from falling out in the event of string failure. For example, the cover may comprise a removable panel with six short protuberances that locate in the ends of the springs. In the event of string failure the panel may be removed to allow a new string to be fitted. Alternatively, a permanent closure, covering a portion of each aperture on the flange may be provided. The closure would prevent the inertial dampers from falling out in the event of string failure, but would still allow access to the interior of the springs for string replacement and spring adjustment.

Each helical tension spring may suitably be provided in series with a lever arm, the lever arm being capable of modifying the behaviour of the spring. The lever arm may be used to confer increased extensibility to the spring, for example, a lever that magnifies the extension by a factor of N also reduces the tension by the same factor of N, with the result that the extensibility is increased by a factor of N squared. As will be easily understood by a person skilled in the art, any other arrangement providing a mechanical advantage, utilising devices such as pulleys or gears, could be used in place of, or in combination with, the lever arm for this purpose.

The musical instrument is preferably a guitar. Alternatively, the musical instrument may be a violin or any other stringed musical instrument. Examples of other stringed instruments in which the invention may be employed include, but are not limited to, the banjo, mandolin, bazouki, balalaika, sitar, viola, cello, double bass, piano, harpsichord, clavichord and harp. Fingered instruments, such as guitars, violins and the like, benefit from increased string extensibility by needing less pressure to hold the string against the finger- or fretboard, giving the instrument a lighter, more refined feel and needing less effort to operate.

Each helical tension spring may conveniently be provided between a bridge and a tailpiece of the guitar. Alternatively, each helical tension spring may be provided between a nut and a tuning peg of the guitar or between a tuning peg and the instrument body. In a further alternative, one helical tension spring may be provided between a bridge and a tailpiece of the guitar and one helical tension spring may be provided between a nut and a tuning peg of the guitar or between a tuning peg and the instrument body.

The helical tension springs are preferably provided with a damping mechanism which provides a delayed extension response to tension changes. This enables a user to utilise the invention while still adding character to their performance using techniques such as vibrato.

For a better understanding of the present invention, and to show more clearly how it may be put into effect, reference will now be made, by way of example, to the accompanying drawings in which.

Figure 1:
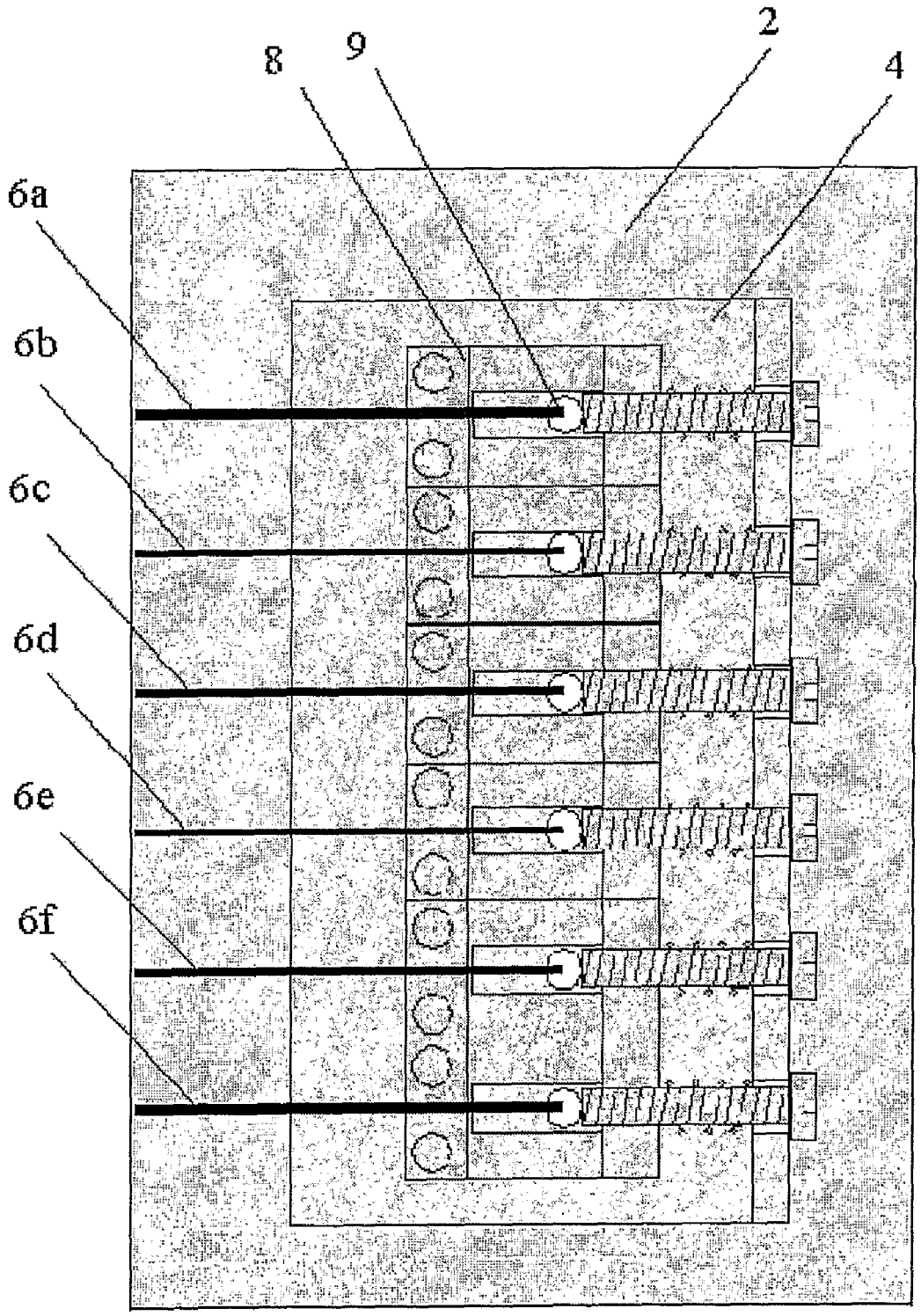
FIG. 1 shows a plan view of a conventional guitar tailpiece assembly.
Figure 2:
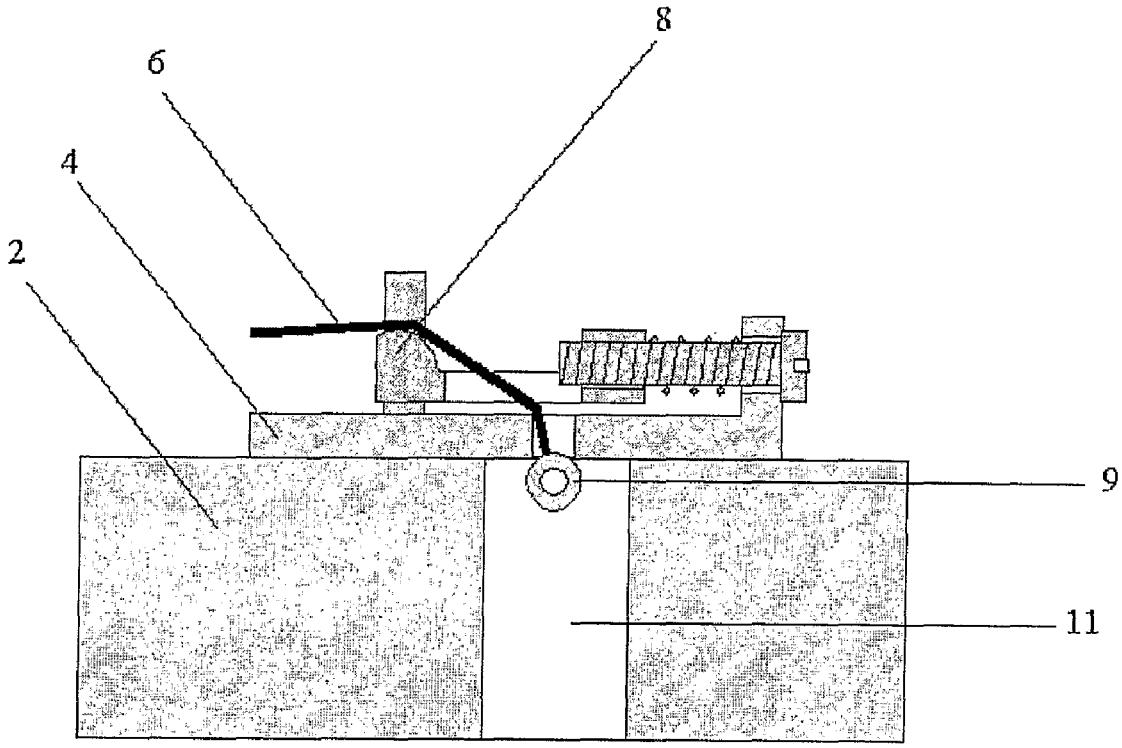
FIG. 2 shows a side section view along line A-A of FIG. 1.

Referring firstly to FIGS. 1 and 2, these show a guitar 2 with a conventional guitar tailpiece assembly 4, as found on most guitars. The guitar 2 comprises six guitar strings 6*a*-6*f* which extend from the tailpiece 4, over the bridge 8, along the neck of the guitar (not shown), over a further bridge, or nut (not shown), and are attached to tuning pegs (not shown), located on the headstock of the guitar 2. As can best be seen in FIG. 2, one of the free ends of each string 6 is provided with a "ball end" 9. This enables the strings 6 to be threaded through a passageway 11 in the body of the guitar 2 such that the ball end 9 abuts the underside of the tailpiece 4 and retains the string 6 in place. At the headstock end each string 6 is wrapped around one of the tuning pegs and is tuned by turning the tuning peg, which causes the tension of the string 6 to increase or decrease and enables the pitch to be varied.

Although the strings 6 are anchored at both ends, the vibrating part of the strings 6, which produces a note when the guitar is played, lies between the bridge 8, located at the tailpiece 4 end, and the nut, located at the headstock end, or any of the frets (not shown) when the string 4 is held against the fret-board by a finger of a user. The portion of each string 6 located between the bridge 8 and the ball end of the string 6, and the nut and the tuning peg does not exhibit significant vibration when the guitar is played and is herein referred to as the "non-vibrating part" of the guitar string 6.

With a configuration as described above, the guitar 2 is prone to going out of tune due to changes in the string tension caused by string stretching or slippage or flexing of the instrument body or play in its string anchor points. When this happens it is necessary to re-tune the guitar 2 by fine adjustment of the or each tuning peg. If the guitar 2 has gone out of tune due to string stretching then eventually, over the course of time, repeated stretching and re-tensioning will cause the string 6 to thin and ultimately snap and it will be necessary to re-string the guitar. String breakage can also occur due to careless or heavy handed over-loading of the strings 6.

Figure 3:
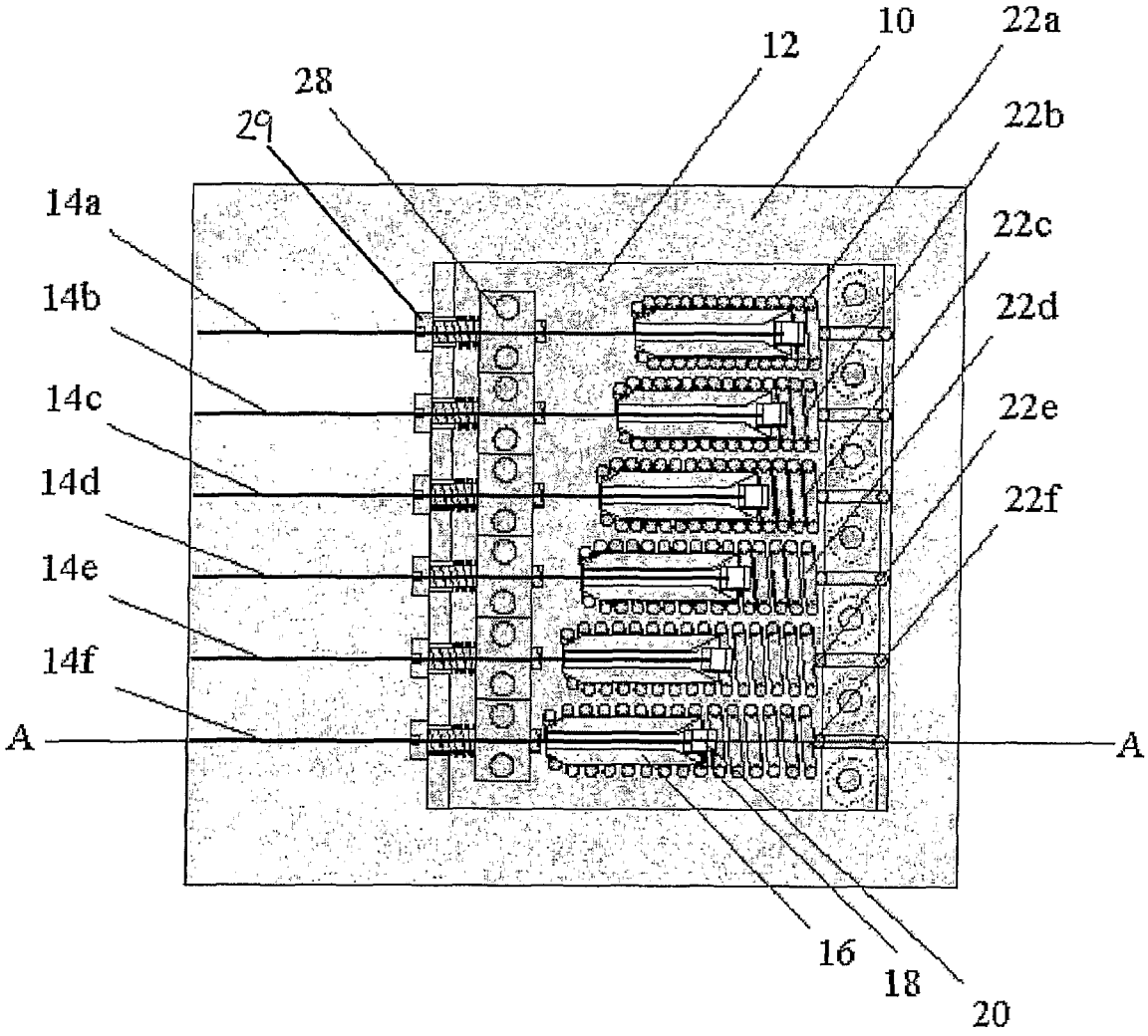
FIG. 3 shows a plan view of a guitar tailpiece assembly comprising a string mounting system according to the present invention.
Figure 4:
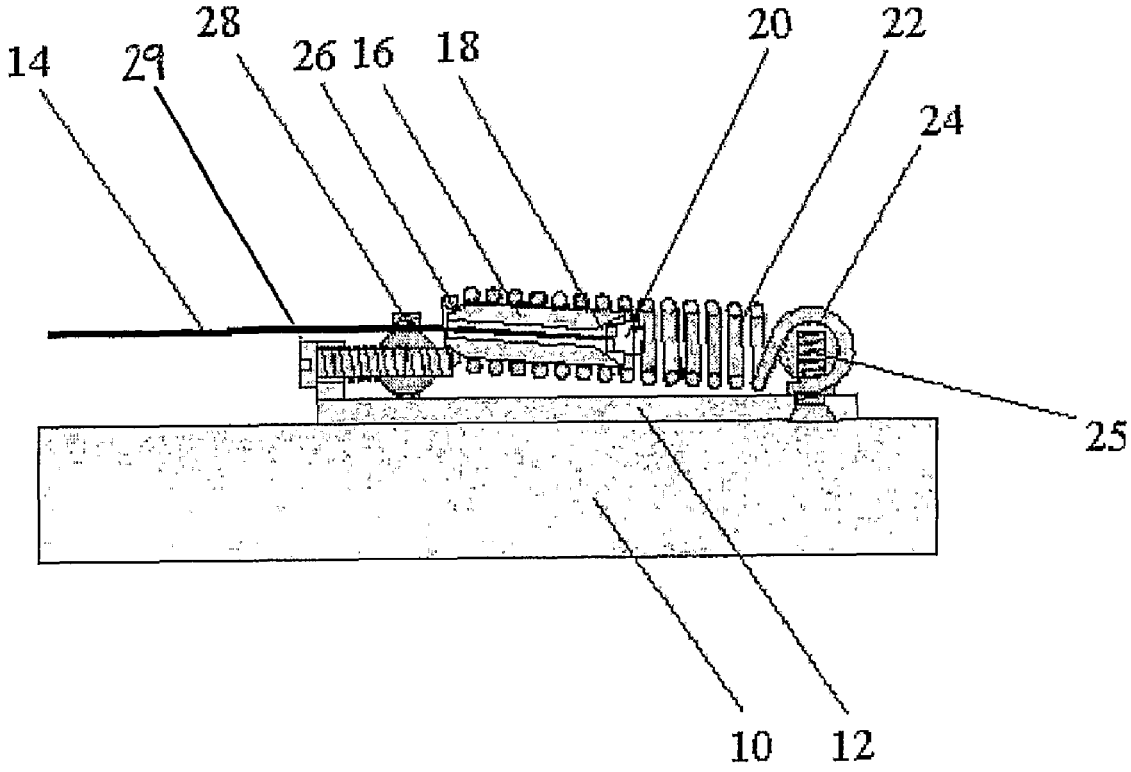
FIG. 4 shows a side section view along line B-B of FIG. 3.

Referring now to FIGS. 3 and 4, these show a guitar 10 having a tailpiece assembly 12 comprising a first embodiment of a string mounting system according to the present invention. Attached to the tailpiece assembly 12 are six helical tension springs 22*a*-22*f*. As can best be seen in FIG. 4, each of the springs 22 is provided with a hook portion 24 at one end which is received in a suitably configured portion of the tailpiece assembly 12. The tailpiece assembly 12 may conveniently be provided with a bar 25 around which the hook portion 24 of each spring 22 conforms. The free end 26 of each spring 22 (the end opposite the hook portion 24) is inwardly tapered.

The strength of the springs 22 are selected to suit the specific stabilisation needs of the particular string 14. In the embodiment shown in FIGS. 3 and 4 each of the springs 22*a*-22*f* are the same. The springs 22 have a strength of 15 kgf, an extensibility of 1 mm/kgf and are pre-tensioned to 4 kgf. However, as stated above, the strength of the springs 22 may be selected to suit the specific stabilisation needs of the string, and each of the springs 22 may be different if necessary.

As with the conventional guitar 2, shown in FIG. 1, the guitar 10 has six strings 14*a*-14*f*. However, rather than being fed through a passageway in the body of the guitar 10 and held in place by the abutment of the ball end with the tailpiece 12, each string is threaded through an inertial damper which is in the form of a pierced end plug 16 having a recess 18 at one end, such that the ball end 20 of each string 14 is retained in the recess 18. The recess 18 is tapered at an angle of approximately 30° to avoid sharp edges cutting into the string 14.

Each of the springs 22*a*-22*f* is aligned along the path of a corresponding one of the strings 14*a*-14*f*. The pierced end plug 16, through which each string 14 is threaded, is received within the spring 22 corresponding to that string 14 and, as the diameter of each spring 22 at its free end 26 is smaller than the diameter of the pierced end plug 16, the end of the plug 16 is compressed against the internal surface of the spring 22 and is retained within the spring 22. The combined mass of the spring 22 and the pierced end plug 16 is far higher than that of the vibrating string 14 and their inertia prevents them from affecting the normal vibration of the string 14. However, at the time scales that slippage or stretching occurs the spring 22 can easily react to tension changes, effectively stabilising the pitch of the string 14 over time. The consequent "softer" behaviour of the strings 22 means that they can be more accurately tuned, require re-tuning less frequently and are less prone to accidental breakage.

The remainder of the guitar 10 is the same as described in relation to the guitar 2 of FIGS. 1 and 2. The strings 14 pass over an adjustable bridge 28, which may be adjusted by means of adjusting screws 29, along the neck of the guitar and via the nut (not shown) to the tuning pegs (not shown).

Figure 5:
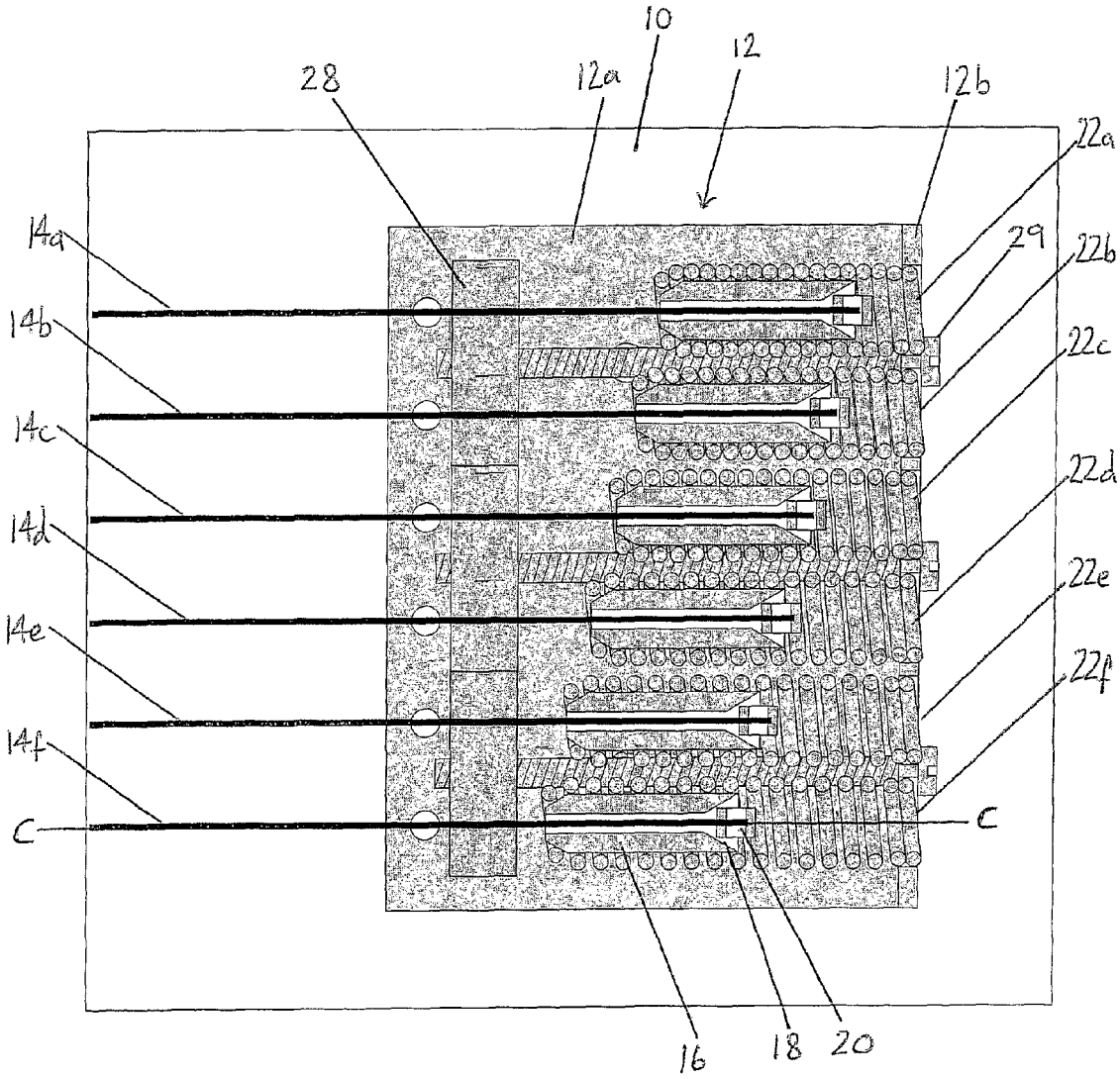
FIG. 5 shows a plan view of a guitar tailpiece assembly comprising a string mounting system according to the present invention.
Figure 6:
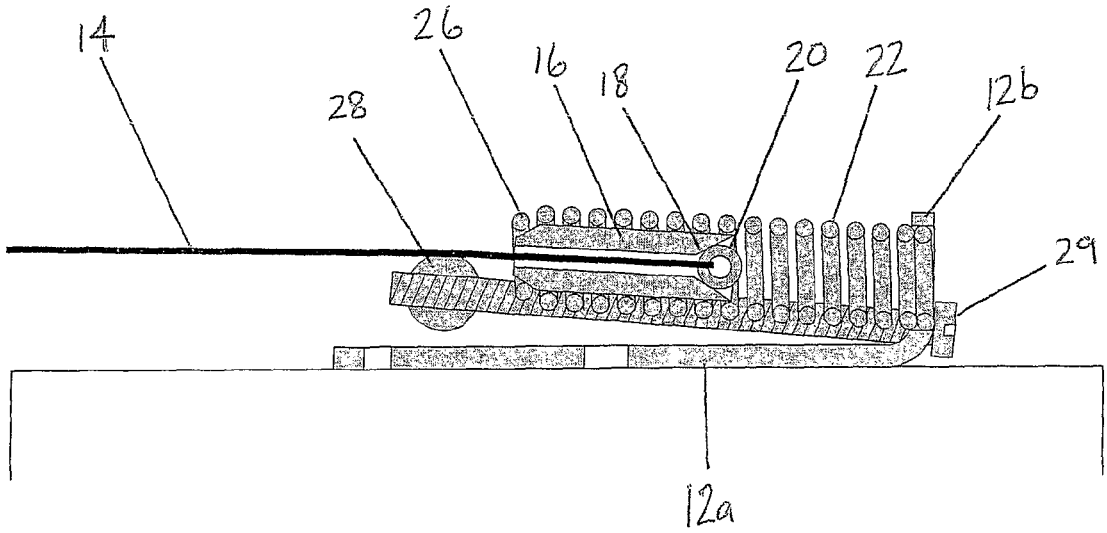
FIG. 6 shows a side section view along line C-C of FIG. 5.

Turning now to FIGS. 5 and 6, these show a guitar 10 having a tailpiece assembly comprising a second embodiment of a string mounting system according to the present invention. The string mounting system is generally the same as that shown in FIGS. 3 and 4 and like parts are numbered the same.

The tailpiece 12 comprises a base plate 12*a*, which is secured to the body of the guitar 10, and a flange 12*b*, located at the rear of the base plate 12*a* and extending perpendicularly to the body of the guitar 10. The flange 12*b* is provided with six circular apertures which are aligned with the six strings 14*a*-*f* and which are sized such that the six helical tension springs 22*a*-f can be screw threaded into the flange 12*b*. The apertures are sized such that the springs 22 are securely fixed to the tailpiece 12.

This means of attachment provides a number of advantages over the prior art string mounting systems. Firstly, it is more compact than previous systems. Secondly, it allows much easier access to the springs 22 to enable the strings 14 to be fitted by feeding them through the corresponding aperture in the flange 12*b* and through the corresponding spring 22. Thirdly, it allows for fine adjustment of the spring 22 stiffness. A user can adjust the degree to which the spring 22 is screwed through the aperture from the rear. By reducing the amount by which the spring protrudes through the aperture its effective length is reduced, thus making it stiffer.

As with the embodiment shown in FIGS. 3 and 4, each string 14 is provided with an inertial damper 16 in the form of a pierced end plug. The inertial damper 16 is massive in comparison to the string 14, that is it has a much larger mass, in order to prevent the spring 22 from conducting energy away from the string 14. The pierced end plugs 16 have a tapered recess 18 in which the ball end of the string 14 is received.

As before, the plugs 16 are received in the body of the appropriate helical tension spring 22 and are held under compression against the inner surface of the spring 22. The last two coils of the spring 22 are tapered inwardly to ensure that the plugs 16 cannot pass through.

The advantage of this embodiment over that shown in FIGS. 3 and 4 is that there is no hook to impede access to the springs 22. It is therefore a much simpler task to fit new strings 14 to the guitar 10 when required.

In contrast to the embodiment shown in FIGS. 3 and 4, the guitar 10 is provided with three adjustable bridges 28, rather than 6. Furthermore, the adjusting screws 29 are located at the rear of the flange 12*b*, rather than under the strings 14. This allows for much easier adjustment of the bridges 28 as the strings 14 do not obscure access. In addition, it also makes the system cheaper to manufacture as there are fewer components.

The string mounting system described in relation to FIGS. 3-6 offers a new way to increase the extensibility of a string without reducing its strength or compromising its desirable acoustic properties. This is achieved by placing helical tension springs 22 in series with a non-vibrating part of each string 14, while freely allowing each string 14 independently to move longitudinally across all the intermediate points of contact with the guitar 10, between its end anchor points. By providing each string 14 with an inertial damper 16 the spring 22 is prevented from affecting the normal vibration of the string 14. Although the helical tension springs 22 are shown located between the bridge 28 and the tailpiece 12, it is also possible to provide them in series with the other non-vibrating portion of the strings 14, between the nut and a tuning peg or between a tuning peg and the instrument body.

The present invention offers more accurate and stable pitch control and it also offers lighter operation. The strings 14 behave in a "softer" manner than the conventional strings 6 shown in FIGS. 1 and 2. The increased extensibility means that less pressure is required to hold the strings 14 against the fret-board, giving the instrument a lighter and more refined feel and needing less effort to operate. Any string 14 stretching or slippage which occurs can be taken up by the springs 22 such that the pitch of the string 14 will remain substantially unaltered. In addition, "softer" strings, such as are achieved with the present invention, can withstand a greater over-extension, because a given extension does not increase the string tension as much. Consequently, the strings 14 should be less prone to snapping and thus last longer.

In addition, the increased extensibility enables the system to provide more accurate tuning. This is because it takes more turns of the winding peg to produce a given change in pitch.

As mentioned above, some instrumentalists like to add character to their performances by adjusting the string tension by varying finger pressure or pushing the string sideways. However, these effects would be greatly reduced with a stabilised string according to the present invention. Any additional bending of the strings 14 would be taken up by the springs 22 and consequently the effect would be reduced. In order to compensate for this undesirable effect a spring damping mechanism (not shown) may optionally be provided. The damping mechanism would provide a damped extension response to tension changes in the strings 14 and allow the instrumentalist to employ effects such as vibrato. The damping mechanism would not materially affect the equilibrium behaviour, but it would affect the dynamic behaviour.

Spring damping systems are well understood and any suitable system could be used in the present invention. For example, the damping mechanism may consist of a piston moving within a cylinder having a small aperture at one end to restrict airflow. Other damping systems may also be used. In order to deliver the desired response, a damping system would need to be mounted in parallel with each spring 22.

Although the present invention has been described with reference to an improved guitar tailpiece assembly it may be utilised with any stringed musical instrument. It will be easily understood by the person skilled in the art how to adapt the string mounting system described for use with other stringed instruments, such as a violin, a piano or any other stringed instrument.

The invention claimed is:

1. A string mounting system for a stringed musical instrument, comprising a helical tension spring connected in series with each string, each string being collinear with its corresponding helical tension spring and each string being provided with an inertial damper, wherein the springs are tapered along at least a portion of their length and the inertial dampers are received wholly within the body of the respective helical tension spring and compressed against an internal surface of the spring wherein each inertial damper comprises an elongate plug defining a back end and a front end, and wherein the string extends through a central passageway from the back end and out the front end.

2. A string mounting system according to claim 1, wherein each inertial damper is massive in comparison to its respective string.

3. A string mounting system according to claim 1, wherein each inertial damper comprises an elongate plug with a central passageway extending at least substantially an entire length of the inertial damper, through which the string is fed.

4. A string mounting system according to claim 3, wherein the back end is provided with a recess for receiving a ball end of a string.

5. A string mounting system according to claim 4, wherein the recess is tapered.

6. A string mounting system according to claim 1, wherein each helical tension spring is connected in series with a non-vibrating part of the string.

7. A string mounting system according to claim 1, wherein each helical tension spring is connected to the stringed musical instrument.

8. A string mounting system according to claim 7, wherein each helical tension spring is screw threaded into a flange of a plate attached to the stringed musical instrument.

9. A string mounting system according to claim 6, wherein the musical instrument is a guitar.

10. A string mounting system according to claim 9, wherein each helical tension spring is provided between a bridge and a tailpiece of the guitar.

11. A string mounting system according to claim 1, wherein the musical instrument is selected from the group consisting of violin, banjo, mandolin, bazouki, balalaika, sitar, viola, cello, double bass, piano, harpsichord, clavichord and harp.

12. A string mounting system according to claim 1, wherein the musical instrument is a guitar.

13. A string mounting system for a stringed musical instrument, comprising a helical tension spring connected in series with each string, each string being collinear with its corresponding helical tension spring and each string being provided with an inertial damper, wherein the inertial dampers are received wholly within the body of the respective helical tension spring and compressed against an internal surface of the spring wherein each inertial damper comprises an elongate plug defining a back end and a front end, and wherein the string extends through a central passageway from the back end and out the front end.

14. An apparatus for mounting a string on a musical instrument, comprising:

a helical tension spring suitably attached to the musical instrument, the helical tension spring having a passageway therethrough along a longitudinal axis of the helical tension spring;

an inertial damper having a passageway extending entirely therethrough along a longitudinal axis of the inertial damper, the inertial damper being situated wholly within the passageway of the helical tension spring and being co-axial therewith;

wherein the inertial damper has a front end and a back end, and wherein the back end receives a ball end of the string;

wherein the inertial damper and the helical tension spring receive the string though their passageways, from the back end of the inertial damper out the front end of the inertial damper.

15. The apparatus of claim 14, wherein the back end of the inertial damper has a tapered recess.

16. The apparatus of claim 14, wherein the front end of the inertial damper is compressed against an internal surface of the helical tension spring.

17. The apparatus of claim 16, wherein the helical tension spring has a tapered free end proximate the front end of the inertial damper.

18. The apparatus of claim 14, wherein the inertial damper is a pierced end plug.

19. The apparatus of claim 14, wherein the string is received through the inertial damper and the helical tension spring simultaneously.

20. The apparatus of claim 17, wherein the front end of the inertial damper is tapered to substantially conform to the tapered free end of the spring.

* * * * *